US007256348B1

(12) United States Patent
Endacott

(10) Patent No.: US 7,256,348 B1
(45) Date of Patent: Aug. 14, 2007

(54) STEP-DOWN IN-LINE BUTT CONNECTOR

(76) Inventor: John E. Endacott, 55 Star Lake Dr., Pensacola, FL (US) 32507

( * ) Notice: Subject to any disclaimer, the term of this patent is extended or adjusted under 35 U.S.C. 154(b) by 0 days.

(21) Appl. No.: 11/360,784

(22) Filed: Feb. 22, 2006

(51) Int. Cl.
*H01R 4/00* (2006.01)

(52) U.S. Cl. ..... 174/84 R; 174/84 C

(58) Field of Classification Search ..... 174/74 R, 174/74 A, 77 R, 80, 84 R, 84 C, 88 R; 29/868, 29/869, 871, 873
See application file for complete search history.

(56) References Cited

U.S. PATENT DOCUMENTS

| | | | | |
|---|---|---|---|---|
| 2,008,227 | A | 7/1935 | Reilly | |
| 2,109,517 | A | 3/1938 | Xenis | |
| 2,247,041 | A | 6/1941 | Bergan | |
| 2,696,518 | A | 12/1954 | Roehmann et al. | |
| 2,895,195 | A | 7/1959 | Ehmann | |
| 2,963,775 | A | 12/1960 | Chadwick | |
| 3,006,983 | A | 10/1961 | McDurmont | |
| 3,008,208 | A | 11/1961 | Stephan | |
| 3,143,595 | A * | 8/1964 | Martin | 174/84 C |
| 3,416,197 | A | 12/1968 | Mark | |
| 3,626,363 | A | 12/1971 | McIver | |
| 3,708,611 | A * | 1/1973 | Dinger | 174/84 C |
| 3,739,460 | A | 6/1973 | Addis et al. | |
| 4,028,487 | A | 6/1977 | McLean et al. | |
| 4,151,364 | A * | 4/1979 | Ellis | 174/84 C |
| 4,208,788 | A * | 6/1980 | Siden | 29/862 |
| 4,289,553 | A * | 9/1981 | Nolf | 156/86 |
| 4,341,921 | A * | 7/1982 | Simpson | 174/84 R |
| 4,595,724 | A * | 6/1986 | Koblitz | 524/409 |
| 4,896,904 | A * | 1/1990 | Gadsden et al. | 285/381.5 |
| 4,959,508 | A * | 9/1990 | McGrane | 174/84 C |
| 5,278,354 | A * | 1/1994 | Lhomme | 174/84 R |
| 5,393,932 | A * | 2/1995 | Young et al. | 174/84 R |
| 5,422,438 | A * | 6/1995 | Lamome | 174/84 C |
| 5,514,836 | A * | 5/1996 | Delalle et al. | 174/87 |
| 5,672,846 | A * | 9/1997 | Marie-Louise Debbaut | 174/84 R |
| 5,749,756 | A | 5/1998 | Vockroth et al. | |
| 5,801,332 | A * | 9/1998 | Berger et al. | 174/73.1 |
| 6,658,735 | B2 * | 12/2003 | Ito | 29/868 |
| 2004/0074667 | A1 * | 4/2004 | Endacott | 174/84 R |

* cited by examiner

*Primary Examiner*—William H. Mayo, III
(74) *Attorney, Agent, or Firm*—Peter Loffler

(57) ABSTRACT

A step-down in-line butt connector receives a pair of wires, one at either end, wherein the wires are each of a different gauge. A hollow tubular body member has a first end and a second end such that the inside diameter and the outside diameter of the first end is larger relatively to the inside diameter and the outside diameter of the second end respectively, while the wall thickness of the body member remains relatively constant between the first end and the second end. An opening is located medially of the body member and may have a stop thereat. The body member is received within a heat shrinkable hollow sleeve that is heated after each end of the body member is crimped in order for the sleeve to form around the body member. A heat activated adhesive within the hollow sleeve helps seal the overall system.

26 Claims, 2 Drawing Sheets

STEP-DOWN IN-LINE BUTT CONNECTOR

BACKGROUND OF THE INVENTION

1. Field of the Invention

The present invention relates to an in-line butt connector that receives a pair of wires, one on each end of the connector, wherein the wires are of a different gauge and crimped thereat and wherein each end of the butt connector is of a different size in order to accommodate the disparate sized wires.

2. Background of the Prior Art

In-line butt connectors are designed to receive a pair of wires in an end to end relationship and to mechanically and electrically connect these wires. The butt connector receives a wire at each end of the connector and thereafter the butt connector is crimped in order to secure each wire and facilitate the mechanical and electrical connection of the wires. In addition, some butt connectors may have solder and/or a heat shrinkable sleeve to further aid in wire connection and to protect the connection from exposure to the elements. Generally, but not always, each of the wires received within the butt connector are of the same gauge. However, sometimes it is necessary to splice a pair of wires wherein one of the wires is of a different gauge than the other, or similarly, to connect three wires together, all possibly of the same gauge, with two wires being received within one end of the butt connector and the third wire being received within the opposite end of the butt connector.

One method employed to facilitate such disparate wiring being received within opposing ends of a butt connector is to provide a butt connector that is sized for the larger diameter wire (or for the two wires). The larger wire (smaller gauge) is received snugly within its end of the butt connector and the smaller wire (larger gauge) is received within the other end and the two ends are crimped appropriately. The problem with this system is that while the end that receives the smaller gauged wire produces a proper crimp, the end that receives the larger gauged wire does not always produce a satisfactory crimp. The larger gauged wire, by being received within an oversized channel of a butt connector due to the fact that the butt connector is sized for the smaller gauged wire, has substantial play within its end of the butt connector. The crimping process may not adequately impact onto this smaller gauged wire resulting in a less than ideal electrical connection and a mechanical connection that is more prone to fail as this smaller wire may have a higher tendency to come loose from its crimped butt connector.

In order to address the above problem, butt connectors have been proposed wherein the inside diameters of each end are different in order to accommodate different sized wires. A smaller gauged wire is received within an end of the butt connector that is relatively larger while a larger gauged wife is received within an end of the butt connector that is relatively smaller. In this way, each wire is within an end of the butt connector that is appropriately sized for the gauge of the wire. However, the problem with this system lies in the fact that in such butt connectors the outside diameter of the butt connector is constant. Accordingly, in the end of the butt connector that receives the smaller gauged wire, the wall of the butt connector at this end is relatively thin (relatively large inside diameter), while at the opposing end, wherein the larger gauged wire is received, the wall of the butt connector is relatively thick (relatively small inside diameter). Due to the disparate wall thicknesses of the opposing ends of the butt connector, it is incumbent upon the technician using the butt connector to apply appropriate and different crimp pressures at each end of the butt connector—a relatively higher pressure on the thick walled end of the butt connector and a relatively smaller pressure on the thin walled end of the butt connector. However, in reality, such is not the case and the crimper tool is not reset between crimps between one end and the other. As such, either insufficient crimp pressure is applied at the thick walled end of the butt connector due to the crimping tool being set to crimp at a pressure at the thin walled end of the butt connector, or too much crimp pressure is applied at the thin walled end of the butt connector due to the crimping tool being set at a pressure to crimp at the thin walled end. In either case, the result is a crimp that is less than satisfactory.

What is needed is a butt connector that can receive a pair of wires in-line (or a trio of wires with two at one end and one at the other) wherein the wires are of different gauges and wherein each end of the butt connector is sized to appropriately receive the disparate sized wires and to be able to crimp upon the wire with a normal setting of the crimping tool.

SUMMARY OF THE INVENTION

The step-down in-line butt connector of the present invention addresses the aforementioned needs in the art by providing a butt connector that can receive a pair of wires in-line (or a trio of wires with two wires at one end and one at the other) wherein the wires are of different gauge and wherein each end of the butt connector is sized to appropriately receive the disparate sized wires in order to be able to crimp upon the wire with a normal setting of the crimping tool. The in-line butt connector is of relatively simple design and construction and is relatively easy to use.

The step-down in-line butt connector of the present invention is comprised of a heat shrinkable hollow sleeve. An elongate hollow body member has a first end with a first inside diameter and a first outside diameter. The first end receives at least one first wire therethrough. The body member also has a second end with a second inside diameter that is smaller relative to the first inside diameter and a second outside diameter that is smaller relative to the first outside diameter. This end receives a second wire therethrough. The body member also has a medial portion. The body member is received within the hollow sleeve and a portion of the at least one first wire is inserted into the first end of the body member, a portion of the second wire is inserted into the second end of the body member, the first end is crimped and the second end is crimped and heat is applied to the hollow sleeve. The at least one first wire is of a smaller gauge relative to the at least one second wire. The body member has a wall thickness that is substantially the same at the first end and at the second end. A stop is disposed within the body member at the medial portion for stopping further wire insertion. An opening is located on the body member at the medial portion. The hollow sleeve is at least partially translucent and may be tinted. An adhesive element is located within the hollow sleeve. The adhesive material is heat activated. The heat shrinkable material is polyolefin. The shrink ratio of the heat shrinkable material is at least about 4 to 1.

BRIEF DESCRIPTION OF THE DRAWINGS

Similar reference numerals refer to similar parts throughout the several views of the drawings.

DESCRIPTION OF THE PREFERRED EMBODIMENT

Figure 1:
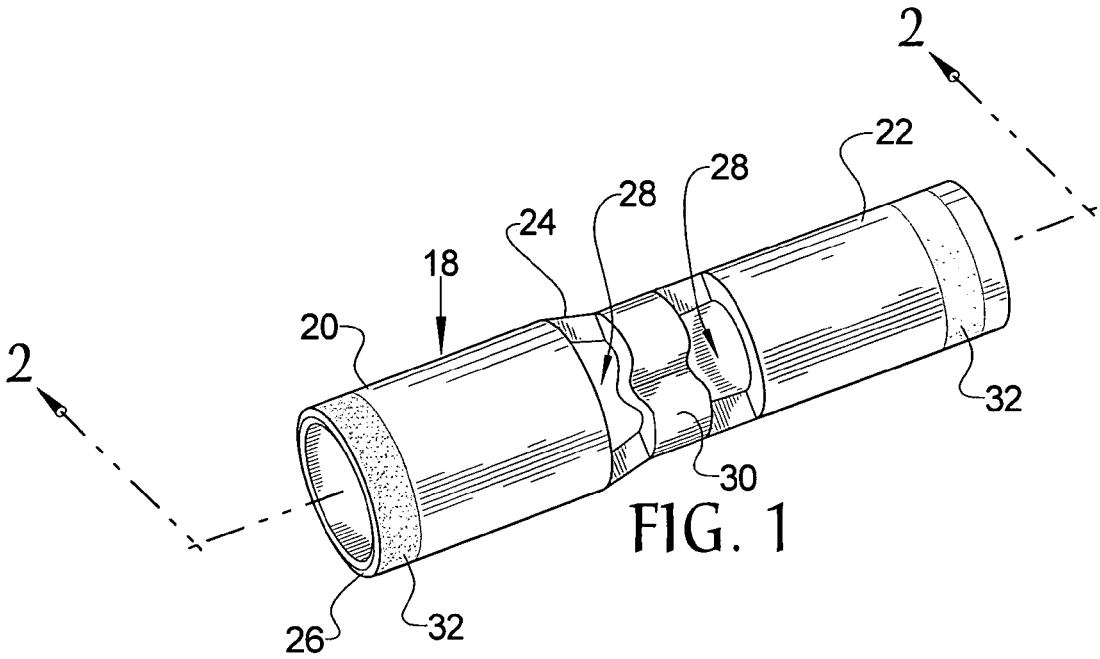
FIG. 1 is a perspective view of the step-down in-line butt connector of the present invention.
Figure 2:
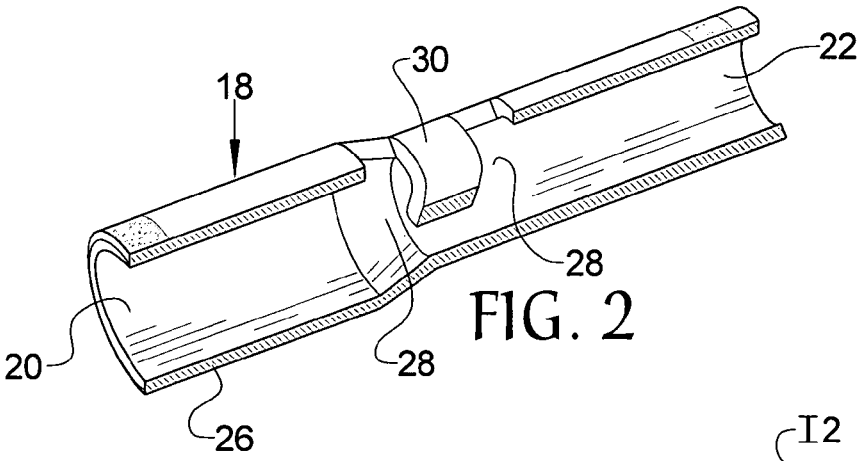
FIG. 2 is a sectional view of the step-down in-line butt connector taken along line 2-2 in FIG. 1.
Figure 3:
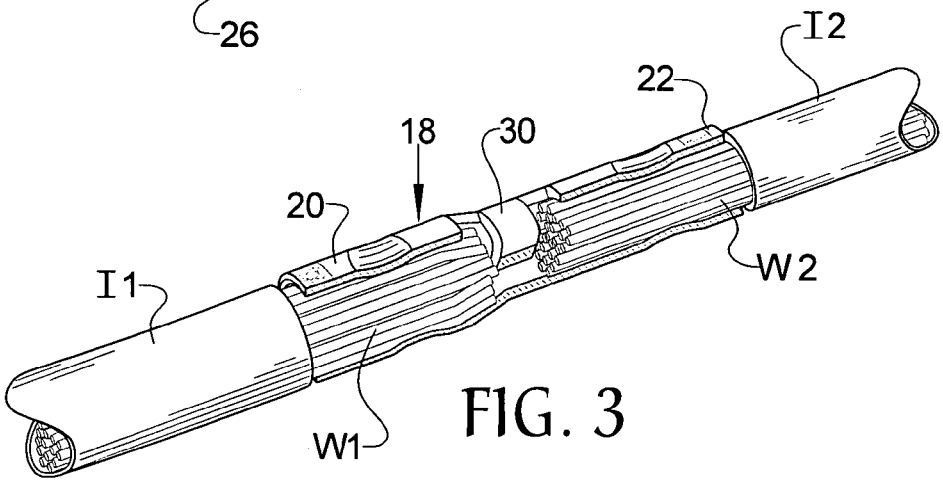
FIG. 3 is a section view of the step-down in-line butt connector with wires crimped in place.
Figure 4:
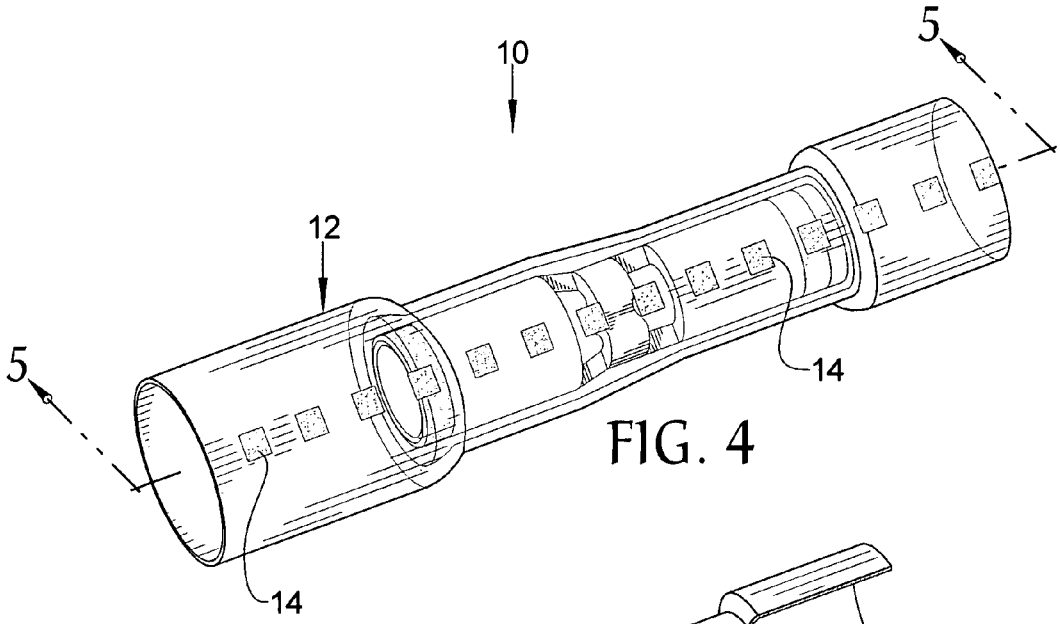
FIG. 4 is a perspective view of the step-down in-line butt connector of the present invention within its hollow sleeve.
Figure 5:
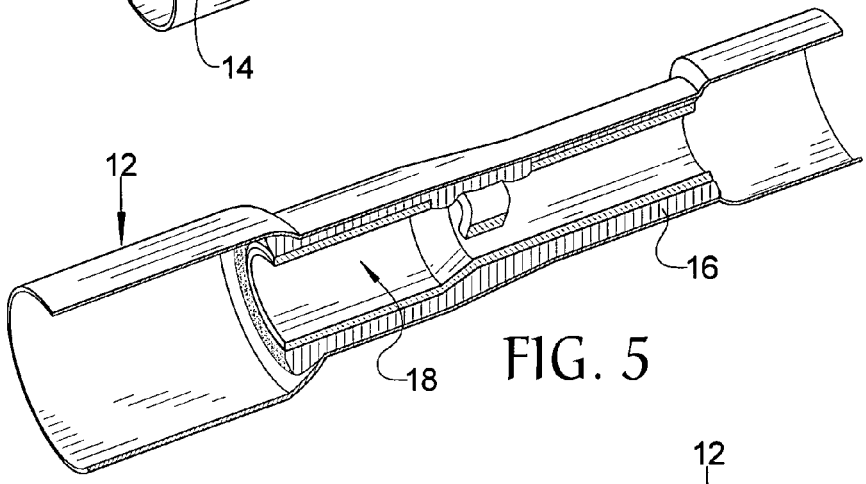
FIG. 5 is a sectional view of the step-down in-line butt connector within its hollow sleeve taken along line 5-5 in FIG. 4.
Figure 6:
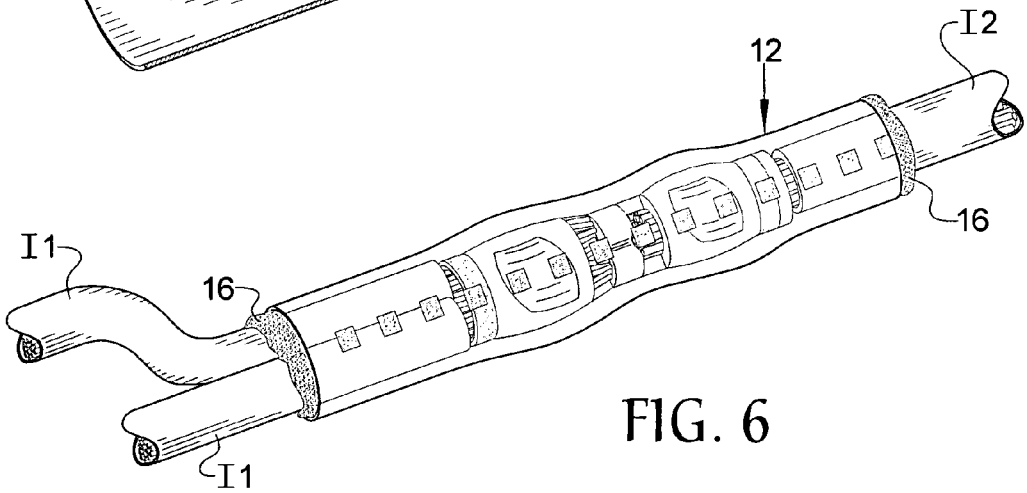
FIG. 6 is a perspective view of the step-down in-line butt connector within its hollow sleeve with two wires on one end of the butt connector and one wire on the other end of the butt connector and the butt connector crimped and the hollow sleeve sealed in place.

Referring now to the drawings, it is seen that the step-down in-line butt connector of the present invention, generally denoted by reference numeral 10, is comprised of a heat shrinkable hollow sleeve 12. The hollow sleeve is at least partially translucent for viewing thereinto and may be tinted, the specific tint corresponding to a specific size to be used for a specific size of body member discussed below, and may have certain identification indicia 14 printed thereon to allow a user to visually determine the size of the hollow sleeve 12. The hollow sleeve 12 may be made from a heat shrinkable material, such as polyolefin, and, advantageously, has a heat shrink ratio at least about 4 to 1, although ratios that are less may also be used. As seen, the medial portion of the hollow sleeve 12 is initially at least partially heat shrunk. An adhesive element 16 is located within the hollow sleeve 12, the adhesive element 16 being co-extruded with the hollow sleeve 12, and the adhesive element 16 being heat activated.

An elongate hollow body member 18 has a first end 20 with a first inside diameter and a first outside diameter the first end receives at least one first wire W1 therethrough, the body member 18 also has a second end 22 with a second inside diameter that is smaller relative to the first inside diameter and a second outside diameter that is smaller relative to the first outside diameter and that receives a second wire W2 therethrough, and the body member 18 has a medial portion 24 and a wall 26. The wall 26 of the body member has a generally constant thickness throughout its length. The medial portion 24 has an opening 28 for viewing of the wires' W1 and W2 progression into the body member 18 and has a stop 30 thereat. The body member 18, which is made from an appropriate material that is relatively easy to crimp, such as copper, annealed or otherwise, is received within the hollow sleeve 12 and a portion of the at least one first wire W1 is inserted into the first end 20 of the body member 18 up to the stop 30, a portion of the second wire W2 is inserted into the second end 22 of the body member 18 up to the stop 30. The first end 20 of the body member 18 is crimped by an appropriate crimp tool (not illustrated) in order to crimp the at least one first wire W1 into the body member 18 and the second end 22 of the body member 18 is crimped by the crimp tool in order to crimp the second wire W2 into the body member 18. Thereafter, heat is applied to the hollow sleeve 12 in standard fashion. The heating of the device 10 causes the hollow sleeve 12 to shrink, allowing the hollow sleeve 12 to recover around the insulation element I1 and I2 of the at least one first wire W1 and the second wire W2 respectively, in order to provide a snug fit of the wires W1 and W2 within the step-down in-line butt connector 10. Additionally, the heating of the device 10 also activates the adhesive element 16 in order to adhere the hollow sleeve 12, to the first insulation element I1, and to the second insulation element I2. This adherence forms a barrier to prevent corrosion of the device 10 and the wires W1 and W2 and also inhibits the entrance of outside contaminants into the system. The hollow sleeve 12 now acts as an insulator of the connected wires W1 and W2, thereby preventing electrical shorts and also providing resistance to abrasion of the connected wires W1 and W2. As the hollow sleeve 12 is translucent, the crimping process can be visually inspected. The tinting of and the indicia 14 on the hollow sleeve 12 can be used to indicate the proper wire gauge to be used with a particular wire connector 10 while color coded bands 32 imprinted on the body member 18 inform the user of the correct crimp setting on the crimp tool.

The larger diameter of the first end 20 of the body member 18 allows for receipt of a relatively smaller gauge of wire W1 or two similar gauged wires W1 relative to the second wire W2 that is received within the relatively smaller diameter of the second end 22 of the body member 18. However, as the wall thickness of the body member 18 is substantially similar at the first end 20 and at the second end 22, the crimp pressure applied by the crimp tool is the same at each end 20 and 22 assuring a relatively clean crimp at each end 20 and 22. Accordingly, the mistakes made by a technician in forgetting to change the crimp pressure setting on the crimp tool are minimized.

While the invention has been particularly shown and described with reference to an embodiment thereof, it will be appreciated by those skilled in the art that various changes in form and detail may be made without departing from the spirit and scope of the invention.

I claim:

1. A wire connector for electrically and mechanically connecting at least one first wire and a second wire, the wire connector comprising:

an elongate hollow body member having a first end with a first inside diameter and a first outside diameter the first end adapted to receive the at least one first wire therethrough, a second end with a second inside diameter that is smaller relative to the first inside diameter and a second outside diameter that is smaller relative to the first outside diameter the second end adapted to receive the second wire therethrough, and a medial portion; and wherein a portion of the first wire is inserted into the first end of the body member, a portion of the second wire is inserted into the second end of the body member, the first end is crimped and the second end is crimped.

2. The wire connector as in claim 1 wherein the at least one first wire is of a smaller gauge relative to the at least one second wire.

3. The wire connector as in claim 1 wherein the body member has a wall thickness that is substantially the same at the first end and at the second end.

4. The wire connector as in claim 1 further comprising a stop disposed within the body member at the medial portion.

5. The wire connector as in claim 1 further comprising an opening located on the body member at the medial portion.

6. The wire connector as in claim 5 further comprising a stop disposed within the body member at the opening.

7. The wire connector as in claim 6 wherein the at least one first wire is of a smaller gauge relative to the at least one second wire.

8. The wire connector as in claim 7 wherein the body member has a wall thickness that is substantially the same at the first end and at the second end.

9. The wire connector as in claim 5 wherein the at least one first wire is of a smaller gauge relative to the at least one second wire.

10. The wire connector as in claim 5 wherein the body member has a wall thickness that is substantially the same at the first end and at the second end.

11. A wire connector for electrically and mechanically connecting at least one first wire and a second wire, the wire connector comprising:

a heat shrinkable hollow sleeve an elongate hollow body member having a first end with a first inside diameter and a first outside diameter the first end adapted to receive the at least one first wire therethrough, a second end with a second inside diameter that is smaller relative to the first inside diameter and a second outside diameter that is smaller relative to the first outside diameter the second end adapted to receive the second wire therethrough, and a medial portion; and wherein the body member is received within the hollow sleeve and a portion of the first wire is inserted into the first end of the body member, a portion of the second wire is inserted into the second end of the body member, the first end is crimped and the second end is crimped and heat is applied to the hollow sleeve.

12. The wire connector as in claim 11 wherein the at least one first wire is of a smaller gauge relative to the at least one second wire.

13. The wire connector as in claim 11 wherein the body member has a wall thickness that is substantially the same at the first end and at the second end.

14. The wire connector as in claim 11 further comprising a stop disposed within the body member at the medial portion.

15. The wire connector as in claim 11 further comprising an opening located on the body member at the medial portion.

16. The wire connector as in claim 15 further comprising a stop disposed within the body member at the opening.

17. The wire connector as in claim 16 wherein the at least one first wire is of a smaller gauge relative to the at least one second wire.

18. The wire connector as in claim 17 wherein the body member has a wall thickness that is substantially the same at the first end and at the second end.

19. The wire connector as in claim 15 wherein the at least one first wire is of a smaller gauge relative to the at least one second wire.

20. The wire connector as in claim 15 wherein the body member has a wall thickness that is substantially the same at the first end and at the second end.

21. The wire connector as in claim 11 wherein the hollow sleeve is at least partially translucent.

22. The wire connector as in claim 21 wherein the hollow sleeve is tinted.

23. The wire connector as in claim 11 further comprising an adhesive element located within the hollow sleeve.

24. The wire connector as in claim 23 wherein the adhesive material is heat activated.

25. The wire connector as in claim 11 wherein the heat shrinkable material is polyolefin.

26. The wire connector as in claim 11 wherein the shrink ratio of the heat shrinkable material is at least about 4 to 1.

* * * * *